US008123216B2

(12) United States Patent
Peterson

(10) Patent No.: US 8,123,216 B2
(45) Date of Patent: Feb. 28, 2012

(54) SYSTEMS AND METHODS FOR CONTROLLING ACTUATOR FORCE AS A CONTROLLABLE REPLACEMENT FOR A COMMON SPRING IN SHEET ARTICLE PROCESSING AND RELATED SHEET ARTICLE PROCESSING APPARATUSES

(75) Inventor: Christopher A. Peterson, Fuquay-Varina, NC (US)

(73) Assignee: Bell and Howell, LLC, Durham, NC (US)

( * ) Notice: Subject to any disclaimer, the term of this patent is extended or adjusted under 35 U.S.C. 154(b) by 214 days.

(21) Appl. No.: 12/712,310

(22) Filed: Feb. 25, 2010

(65) Prior Publication Data

US 2011/0204562 A1 Aug. 25, 2011

(51) Int. Cl.
*B65H 9/04* (2006.01)

(52) U.S. Cl. ..... 271/245; 271/2; 271/271

(58) Field of Classification Search ..... 271/243, 271/245, 246, 247, 2, 271; 270/58.06
See application file for complete search history.

(56) References Cited

U.S. PATENT DOCUMENTS 3,863,912 A * 2/1975 Korff ..... 271/245
(Continued)

*Primary Examiner* — Jeremy R Severson
(74) *Attorney, Agent, or Firm* — McDermott Will & Emery LLP

(57) ABSTRACT

Methods and systems are disclosed for registering and moving a sheet article along a path that can use an actuator to mimic a biased device such as a spring-loaded device. The actuator can include a solenoid and an arm. The movement of the arm with the solenoid can be done by pulse-width modulation by providing a high pulse-width modulation duty cycle to the solenoid to provide a resistive force on the arm and providing a low pulse-width modulation duty cycle to the solenoid to provide a less resistive force on the arm. Inserting stations use in sheet article inserting system that employ the actuator are also provided.

20 Claims, 14 Drawing Sheets

U.S. PATENT DOCUMENTS 4,473,222 A * 9/1984 Simmons et al. ..... 271/245
4,526,309 A * 7/1985 Taylor et al. ..... 226/33
4,669,721 A * 6/1987 Westover ..... 271/272
4,882,989 A * 11/1989 Nobile ..... 101/235
4,898,375 A * 2/1990 Holtje ..... 271/246
5,018,719 A * 5/1991 Wilson et al. ..... 271/246
5,147,092 A * 9/1992 Driscoll et al. ..... 271/184
5,233,400 A * 8/1993 Cahill ..... 399/395

* cited by examiner

SYSTEMS AND METHODS FOR CONTROLLING ACTUATOR FORCE AS A CONTROLLABLE REPLACEMENT FOR A COMMON SPRING IN SHEET ARTICLE PROCESSING AND RELATED SHEET ARTICLE PROCESSING APPARATUSES

TECHNICAL FIELD

The subject matter disclosed herein relates generally to apparatuses, systems, and methods that employ an actuator that can be used, for example, in place of a biased device such as, for example, a spring-loaded device. More particularly, the subject matter disclosed herein relates to apparatuses, systems, and methods that employ a pulse-width modulation controlled actuator that can replace a spring-loaded device, for example, to create different levels of drag on sheet articles such as envelopes to properly align such sheet articles with in a sheet processing device.

BACKGROUND

Mechanical devices, such as spring-loaded devices, are commonly used to provide a resistance during some portion of a process. Such spring-loaded devices can be tailored to provide a necessary amount of resistance to accomplish the desired effect of the resistance. Sometimes, it is desirable for such spring-loaded devices to provide different amounts of resistance at different times of a process or depending on the type of item being processed. For example, in some processes it can be desirable for the spring-loaded device to provide enough resistance to stop an item being processed along a process path and then provide less resistance or drag to controllable allow the item being processed to move along the process path. However, such spring-loaded devices, such as a common torsion spring, typically cannot provide a dual amount or different amounts of resistances on an object without some other mechanical force acting on the spring-loaded device, such as by varying size of an item being processed when the spring-loaded device and process path are at a constant distance or by varying the distance between the spring-loaded device and the process path. Thus, it is often necessary to determine a spring force that will at least partially fulfill the intent of the different amounts of resistance.

As in sheet article processing, spring-loaded devices can be used to align the sheet articles for processing and regulate flow therethrough by providing resistance that is applied against the sheet article as it passes such spring-loaded devices. For example, a standard set of rotary, spring return, registration fingers is often used in sheet article processing to register, i.e., properly align, the sheet articles being processed but still permit the sheet articles to pass by the registration fingers. For instance, it is desirable for the fingers to have enough force to serve as a registration surface for an object, such as an envelope or document that is being fed into a processing station at a significant velocity. It is also desired that the force of the spring-loaded device be light enough for the object to subsequently be pushed through these same registration fingers without damage or deformation of the object due to excessive resistance of the registration fingers. However, even finding a compromise force to fulfill these dual purposes for the rotary spring, such as a simple torsion spring, on the rotating fingers, still does not provide satisfactory results that truly meets both of these requirements.

A need exists for systems and methods that can act operate in a manner similar to spring-loaded devices, but can provide better options for resistance.

SUMMARY

In accordance with this disclosure, apparatuses, systems, and methods that employ controllable actuators that can provide multiple levels of resistance are provided. It is, therefore, an object of the present disclosure to provide an actuator that can be used in place of a biased device, such as, for example, a spring-loaded device. More particularly, the subject matter disclosed herein relates to a pulse-width modulation controlled actuator that can be used in place of a spring-loaded device, for example, to create different levels of drag on sheet articles such as envelopes to properly align such sheet articles.

An object of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1A:
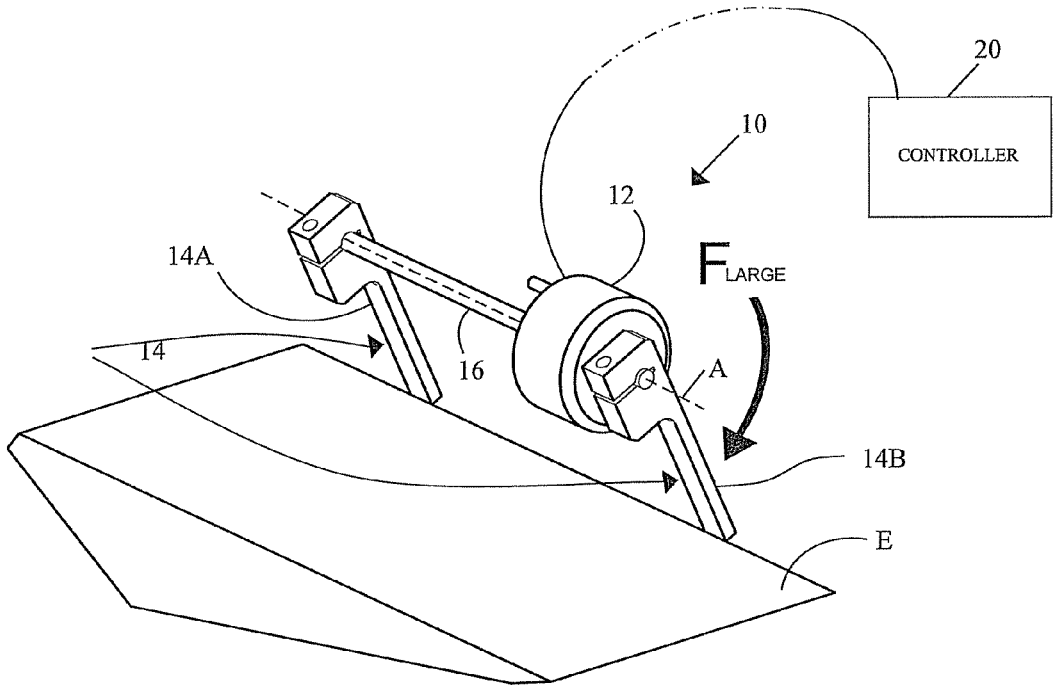
FIG. 1A illustrates a top perspective view of an embodiment of a pulse-width modulation controlled actuator with a resistive force applied to an arm of the actuator according to the present subject matter.

Reference will now be made in detail to the description of the present subject matter, one or more examples of which are shown in the figures. Each example is provided to explain the subject matter and not as a limitation. In fact, features illustrated or described as part of one embodiment can be used in another embodiment to yield still a further embodiment. It is intended that the present subject matter covers such modifications and variations.

The term "sheet article" is used herein to designate any sheet article, and can comprise, for example and without limitation, envelopes, sheet inserts folded or unfolded for insertion into an envelope or folder, and any other sheet materials.

The term "mail article" is used herein to designate any article for possible insert into a mailing package, and can comprise, for example and without limitation, computer disks, compact disks, promotional items, or the like, as wells any sheet articles.

The term "duty cycle" is used herein to describe the proportion of "on time" when power is being supplied by a pulse-width modulation (also referred to herein as "PWM") controller to "off time" when power is not supplied by the PWM controller. Duty cycle is generally expressed in percent with 100% being fully on. For example, a low duty cycle corresponds to low power, because the power is off for most of the time, while a high duty cycle corresponds to high power, because the power is on for most of the time.

The term "document set" is used herein to designate one or more sheet articles and/or mail articles grouped together for processing.

As defined herein, the term "insert material" can be any material to be inserted into an envelope, and can comprise, for example and without limitation, one or more document sets, sheet articles, mail articles or combinations thereof.

The present subject matter describes methods and systems for using a pulse-width modulation controlled actuator in place of a biased device such as, for example, a spring-loaded device. The method of control can be applied to both linear and rotational devices. Using a pulse-width modulation controlled solenoid, for example, allows for dynamic control and manipulation of the effective force of the solenoid. This is particularly useful in applications where it is desired for a mechanical device to have a high holding or return force during some portion of a process, while having a lighter, spring-like force during other portions of a process.

Such pulse-width modulation controlled actuators can be used in conjunction with a standard set of rotary, spring return, registration fingers used in sheet article processing. For example, such embodiments can be used in inserting stations or systems. Such inserting stations, or inserting systems can be used, for example, for processing sheet articles and mail articles such as envelopes, folders, flats, insert materials, and documents sets. In the inserting station, sheet articles such as envelopes and flats can be registered, held in a stationary position and/or opened for inserting insert material therein. The sheet articles and mail articles can also be registered, held and/or inserted into other sheet articles such as envelopes and flats in the inserting station. Further, processing to such sheet articles such as envelopes, folders, flats, insert materials, and documents sets can also occur in the inserting station.

In such embodiments of the actuators, it can be desirable for the fingers to have enough force to serve as a registration surface for an object or sheet article, such as envelope or other document, being fed into the fingers at a significant velocity. It can also be desirable that the force of the actuator be light enough for the object or sheet article, such as an envelope or other document, to subsequently be pushed through these same registration fingers without damage or deformation of the object or sheet article due to excessive resistance of the registration fingers. By using a rotary solenoid implementing the PWM control method disclosed herein, these dual requirements can be achieved. When the object to be registered is being fed into the fingers, the PWM duty cycle can be at or near 100% providing maximum force for registration during impact. Having the PWM duty cycle at or near 100% can also provide the quickest possible return time to the registration position. Then, when it is desired for the object to be easily pushed through the fingers, the PWM duty cycle can be drastically reduced in order to provide the desired (lighter) resistive force.

This control method of an electric solenoid contrasts with a spring-loaded device where the force created by the solenoid is typically greatest when it is fully engaged. In the example above, the effective force or resistance that the registration fingers have is reduced when the object is forced through the registration fingers and they are rotated in the direction opposite of the energizing force. Conversely, if a spring were used, the force would actually increase as the fingers are rotated against the spring.

Figure 1B:
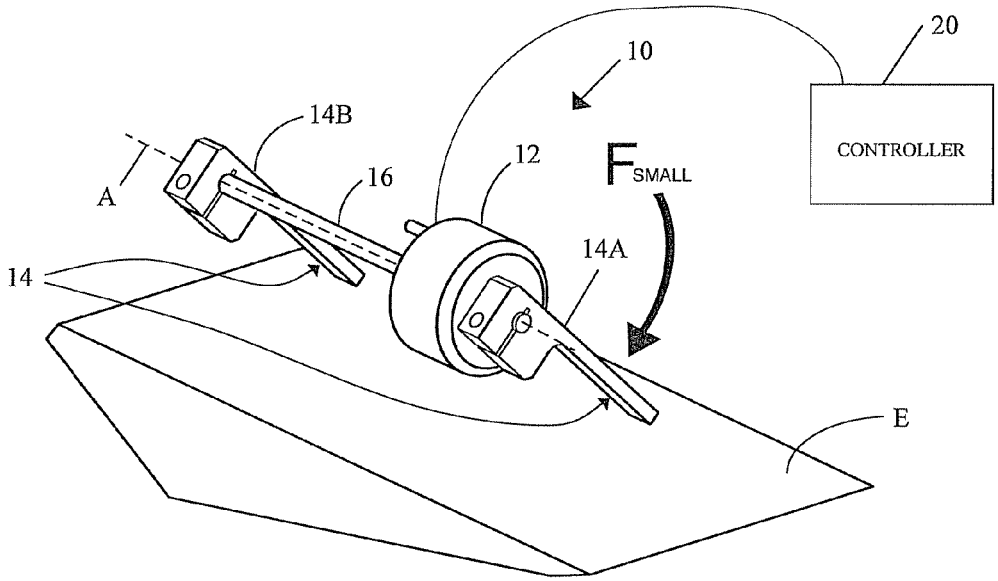
FIG. 1B illustrates a top perspective view of an embodiment of a pulse-width modulation controlled actuator with a less resistive force applied to an arm of the actuator according to the present subject matter.

FIGS. 1A and 1B illustrate an actuator, generally designated 10. The actuator 10 can comprise a solenoid 12 and an arm generally designated 14. The solenoid 12 can be a rotary solenoid as shown. Alternatively, the solenoid 12 can be a linear solenoid. The solenoid 12 can comprise a shaft 16 on which the arm 14 can be attached. The arm 14, for example, can be a single structure. Alternatively, the arm 14 can comprise two or more fingers 14A, 14B that are spaced apart from each other and can be positioned at opposing ends of the shaft 16. With a rotary embodiment, the solenoid 12 can rotate the shaft 16 such that the arm 14 rotates about an axis A passing through the shaft 16.

The actuator 10, and in particular the solenoid 12, can be in communication with a controller 20 that provides a pulse-width modulated power supply to the solenoid 12. The pulse-width modulated power supply applied to the solenoid 12 creates rotational forces on the arm that vary in intensity depending on the amount of voltage supplied during pulses of high voltage and intervals of low voltage or no voltage. The solenoid can be in wired communications with the controller 20. Alternatively, the controller 20 can be in wireless communications with a power supply that acts as part of the controller 20 with the power supply wired to supply power to the solenoid. The controller 20 can thus modulate the power supply remotely.

By using pulse-width modulation of the power supplied to the solenoid 12, the force applied by the actuator 10 can be controlled by a method that can mimic a spring-loaded device. The actuator 10 with the solenoid 12 and arm 14 can be controlled by the controller 20 so that the movement of the arm 14 with the solenoid 12 is controlled by pulse-width modulation as described above. The controller 20 can provide a pulse-width modulation having a high pulse-width modulation duty cycle to the solenoid 12 to provide a resistive force $F_{LARGE}$ on the arm 14 as shown in FIG. 1A. A high pulse-width modulation duty cycle can be any duty cycle that can create a resistive force $F_{LARGE}$ on the arm 14 of the actuator 10 great enough to prevent passage of an object, such as envelope E, past the arm 14 of the actuator 10. For example, a high pulse-width modulation duty cycle can be a duty cycle of about 100% that provides a maximum force on the arm 14. In fact, in some embodiments, the level of voltage provided can be higher than the voltage for which the solenoid is rated. This over-excitation can cause the fingers to swing into its lowered blocking position very quickly. Since the voltage level is only high for short periods of time and this over-excitation period is mixed with other periods of low voltage, the average voltage applied to the solenoid does not exceed its rated amount. In another example, the high pulse-width modulation duty cycle can be between about 50% and about 100%. Such duty cycles can depend on the amount of maximum voltage accessible to the controller and actuator, the type and size of the object, and the amount of force acting on the object and actuator.

The controller 20 can provide a pulse-width modulation having a low pulse-width modulation duty cycle to the solenoid 12 to provide a less resistive force $F_{SMALL}$ on the arm 14 as shown in FIG. 1B. A low pulse-width modulation duty cycle can be any duty cycle that can create a less resistive force $F_{SMALL}$ on the arm 14 of the actuator 10 that is small enough to allow passage of an object, such as envelope E, past the arm 14 of the actuator 10. For example, the low pulse-width modulation duty cycle can be between about 1% and about 70%. Again, such duty cycles can depend on the amount of maximum voltage accessible to the controller, the type and size of the object, and the amount of force acting on the object and actuator.

Figure 1C:
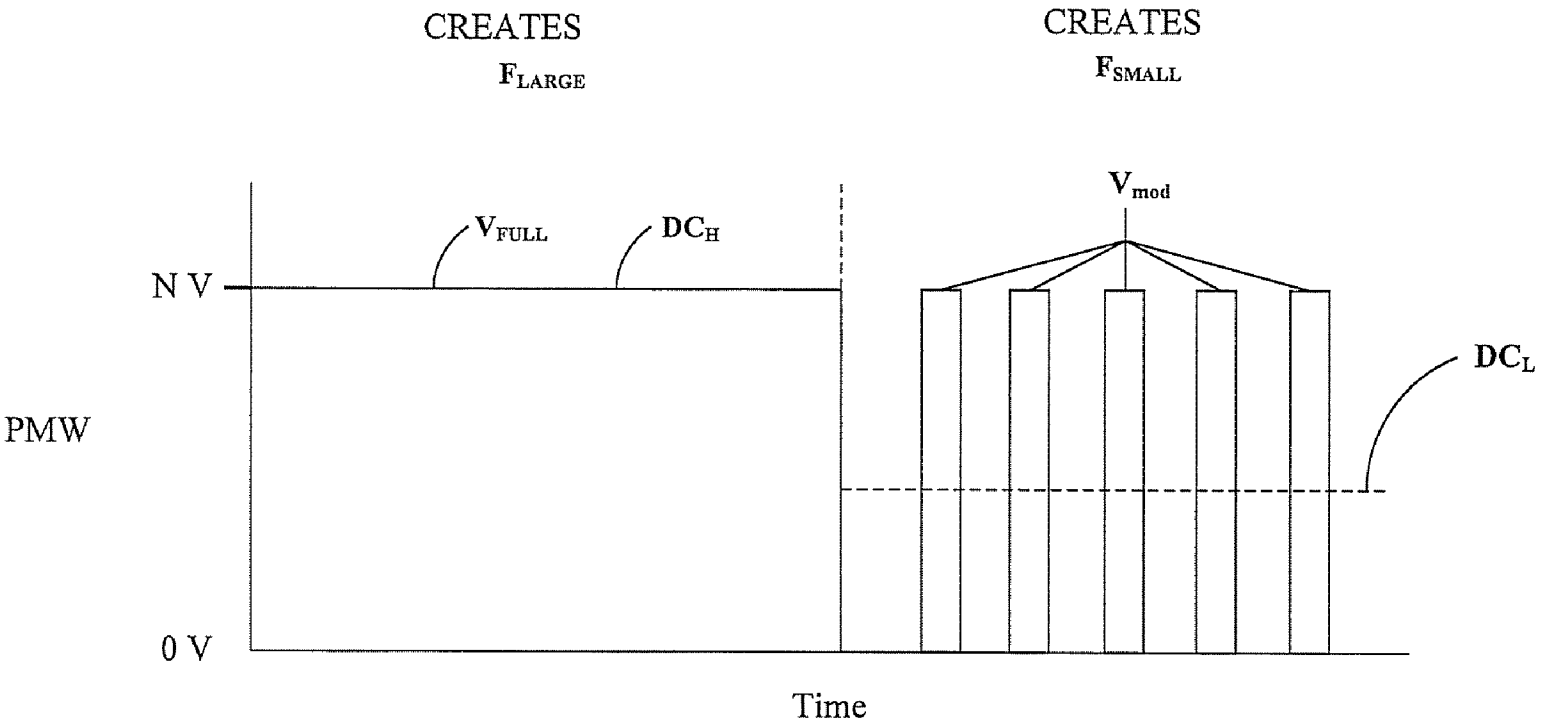
FIG. 1C illustrates a graphic representation of an embodiment of the pulse-width modulation used to create the resistive force and the less resistive force and the respective pulse-width modulation duty cycle of each according to FIGS. 1A and 1B.

FIG. 1C illustrates a schematic graphical representation to illustrate an embodiment of the concept of a pulse-width modulation that can be used to supply power to the actuator 10 to create the force $F_{LARGE}$ and the force $F_{SMALL}$ on the arm 14. The on and off periods of the voltage for the modulated portion in the graph of FIG. 1C are exaggerated to illustrate the concept. In practice, the ON and OFF periods for the voltage can typically be extremely short in duration (for example, milliseconds), thus making it difficult to illustrate accurately in a graph.

As shown in FIG. 1C, the maximum voltage that can be supplied to the actuator is N volts. When the actuator 10 is expected to hold an object, such as envelope E, a high pulse-width modulation duty cycle $DC_H$ (superimposed with line $V_{FULL}$) for the time period for holding the object can be used. This creates the force $F_{LARGE}$ on the arm 14 as shown in FIG. 1A that can hold an object, such as envelope E. For example, as shown in FIG. 1C, the high pulse-width modulation duty cycle $DC_H$ can be about 100% meaning that the supply of voltage is maintained "on" over this time period to provide a maximum voltage $V_{FULL}$ over this time period. As described above, the high pulse-width modulation duty cycle $DC_H$ can be less than 100% with a different modulation pattern. Similarly, at least a portion of the high pulse-width modulation duty cycle $DC_H$ can be greater than 100% with a different modulation pattern to provide an over-excitation.

When the actuator 10 is expected to release an object, such as envelope E, to allow it to pass the arm 14 of the actuator 10, a low pulse-width modulation duty cycle $DC_L$ for the time period for holding the object can be used. This creates the force $F_{SMALL}$ on the arm 14 as shown in FIG. 1B. For example, as shown in FIG. 1C, the low pulse-width modulation duty cycle $DC_H$ can be much lower than the high pulse-width modulation duty cycle $DC_H$. The low pulse-width modulation duty cycle $DC_L$ can be created by intermittent supplies of voltage $V_{mod}$ meaning that the supply of voltage is maintained "ON" only over certain portions of this time period. The low pulse-width modulation duty cycle $DC_L$ can vary. As described above, the low pulse-width modulation duty cycle $DC_L$ can depend on the amount of maximum voltage accessible to the controller and actuator and the type and size of the object. Further, different modulation patterns can be used to create the low pulse-width modulation duty cycle $DC_L$.

As shown in FIG. 1C, the pulse-width modulation having the high pulse-width modulation duty cycle $DC_H$ can be immediately followed by the pulse-width modulation having the low pulse-width modulation duty cycle $DC_L$. Depending on the process in which the actuator 10 is used, the steps of providing the high pulse-width modulation duty cycle $DC_H$ and providing the low pulse-width modulation duty cycle $DC_L$ can be continually repeated when processing multiple objects.

As shown in FIG. 1A, the arm 14 can be moved to an active position during application of the high pulse-width modulation duty cycle $DC_H$ to the solenoid 12. This means that the arm 14 is forced to rotate into and held in a blocking position, shown in FIG. 1A to permit holding of an object. During the application of the low pulse-width modulation duty cycle $DC_L$ to the solenoid 12, the arm is movable to a passive position. This means that the arm 14 is held in a rotated position similar to the active position, but the force applied is smaller to permit the object to push past arm 14 to move the arm 14 to the passive position. Thereby, the actuator 10, and in particular, the solenoid 12, does not need a return spring mechanism therein for returning the arm from the active position.

Referring now to FIGS. 2-6, one example of a system and method for registering and moving objects, such as sheet articles, along a process path is provided in further detail. In FIGS. 2-6, a system 40 is provided. In this embodiment, the objects being processed in the system 40 are sheet articles although any suitable articles could be processed and used according to the present disclosure. For example, the sheet articles can be envelopes $E_1$, $E_2$. The system 40 can be used to register, i.e. properly align, and move the sheet articles within a process. The system 40 can be part of a large system. For example, the system 40 can define a portion of an inserting system for mail processing that can be used for inserting material into items such as envelopes, folders and the like.

As seen in FIGS. 2-6, the system 40 can comprise a process path 30 for conveying the sheet articles, as shown herein, envelopes $E_1$, $E_2$, from an upstream position U to a downstream position D. The system 40 can also comprise an actuator 10 as described above that comprises a solenoid 12 and an arm 14. The solenoid 12 can be a rotary solenoid and can comprise a shaft 16 on which the arm 14 can be attached. The arm 14, for example, can be a single structure. Alternatively, the arm 14 can comprise two or more fingers 14A, 14B that can be spaced apart from each other along the shaft 16. The actuator 10 can be positioned at a predetermined location along the process path 30 proximate to the process path 30. For example, the actuator 10 can be located at an insertion station where the envelopes $E_1$, $E_2$ can be registered and stuffed with insert material I before being allowed to move on down the process path 30. The insert material I can, for example, comprise sheet articles and mail articles.

A controller 20 (FIGS. 1A and 1B) can also be included in the system 40 that can control the movement of the arm 14 with the solenoid 12 by pulse-width modulation. As described above, the controller 20 can provide a high pulse-width modulation duty cycle to the solenoid to provide a maximum force on the arm to position the arm in the process path to register the sheet article against the arm to align the sheet article in a predetermined position. The controller 20 can also provide a low pulse-width modulation duty cycle to the solenoid to provide a less resistive force on the arm to permit the sheet article to push past the arm along the process path.

The process path can comprise one or more openings 32 into which the arm 14 can be extend upon application of the maximum force by the solenoid. One or more pusher members 34 for moving a sheet article along the process path 30 can be provided. The pusher members 34 can travel along the openings 32 in the process path 30. The pusher members 34 can be moved along the process path 30 by one or more movable conveyor devices, such as a belt, a chain, or the like. In the embodiment shown, at least some of the pusher members 34 can be used to push insert material I along the process path 30 and into the envelopes $E_1$, $E_2$. As stated above, the insert material I can comprise sheet articles and mail articles. The insert material I can form document sets that can be inserted into the envelopes $E_1$, $E_2$.

The arm 14 can be rotatable into an active position in the process path upon providing the high pulse-width modulation duty cycle $DC_H$ to the solenoid (see as an example FIG. 1C). The arm 14 is configured to be movable to a passive position during the low pulse-width modulation duty cycle $DC_L$ to the solenoid (see as an example FIG. 1C). The solenoid 12 can be configured such that, upon providing the low pulse-width modulation duty cycle $DC_L$ to the solenoid 12, the envelopes $E_1$, $E_2$ with the insert material I inserted therein can be movable past the arm 14 along the process path 30. The arm 14 in this manner can be rotatable out of the process path 30 by the movement of the envelopes $E_1$, $E_2$. In such an embodiment, the actuator 10 does not need a return spring mechanism secured therein for returning the arm 14 from an active position.

An embodiment of a method that can be used on the system 40 for registering and moving a sheet article along a process path 30 will now be described. The actuator 10 that comprises the solenoid 12 and arm 14 can be controlled, for example, by the controller 20. In particular, the movement of the arm 14 with the solenoid 12 can be controlled by pulse-width modulation to provide different levels of force on the arm 14, thereby providing different levels of resistance against applied torque from the contact of the sheet articles against the arm 14. Sheet articles, in the form of the envelopes $E_1$, $E_2$, can be moved into and along the process path 30.

Figure 2:
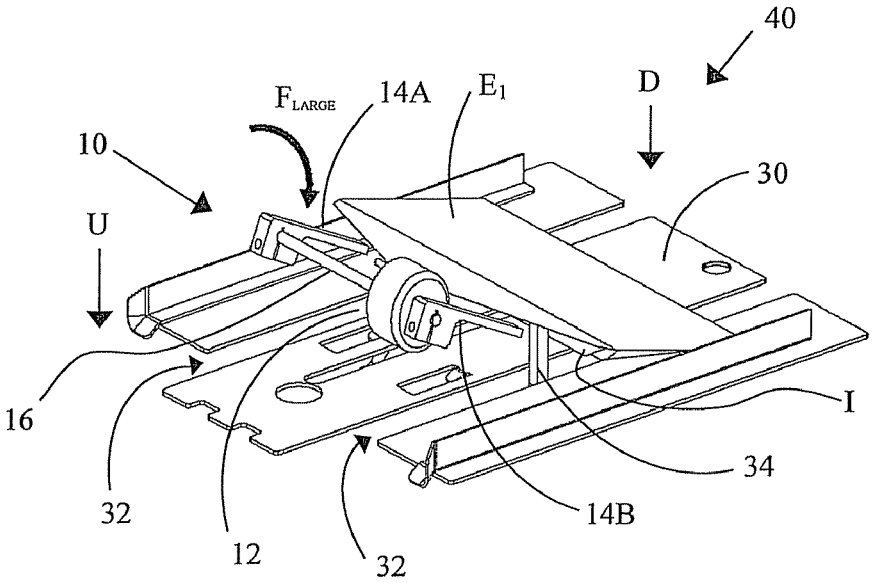
FIGS. 2-6 illustrate perspective views of steps that can be used in registering and moving an object along a process path using an embodiment of a system using a pulse-width modulation controlled actuator according to FIGS. 1A and 1B.

As shown in FIG. 2, after a first envelope $E_1$ is stuffed and moved out of the insertion station, a pulse-width modulation having a high pulse-width modulation duty cycle can be supplied to the solenoid 12 of the actuator 10 to provide a resistive force $F_{LARGE}$ on the arm 14 to position the arm 14 in the process path 30. As stated above, the solenoid 12 can be a rotary solenoid that rotates the shaft 16 and the arm 14 attached thereto about an axis.

Figure 3:
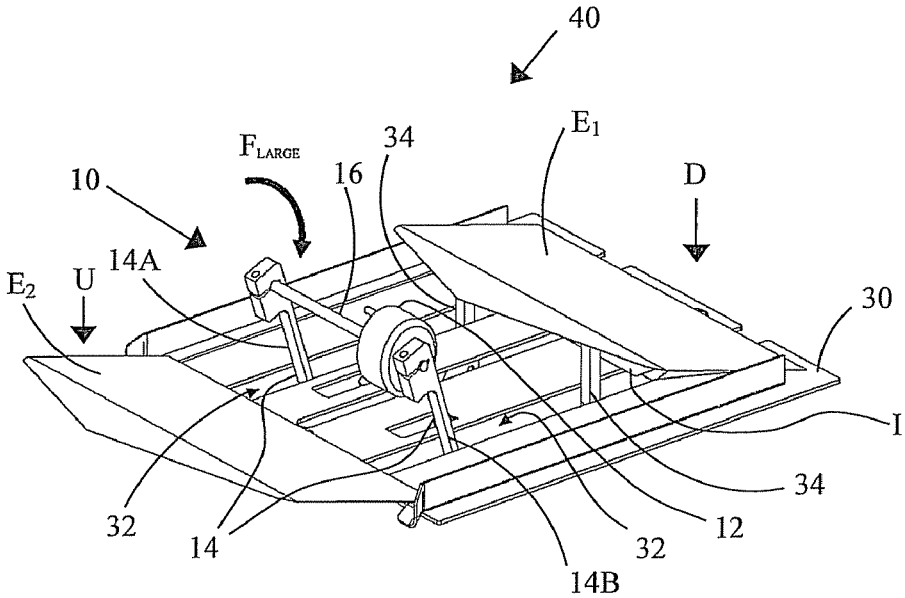

This rotation of the arm 14 with the solenoid 12 using a high pulse-width modulation duty cycle to create a resistive force $F_{LARGE}$ moves the arm 14 into an active position in the process path 30. In this active position, the arm 14 can extend through the process path 30. For example, the arm 14 in the form of fingers 14A, 14B can extend into the openings 32 in the process path 30 in which the pusher members 34 can travel as shown in FIG. 3. This active position that blocks the movement of the envelopes can also be considered the registration position of the arm 14 that will provide proper alignment of the next envelope $E_2$. As shown in FIG. 3, the rotation of the arm 14 with the solenoid 12 into an active position in the process path 30 using a high pulse-width modulation duty cycle to block the movement of the envelopes can occur before the next envelope $E_2$ arrives. As stated above, the high pulse-width modulation duty cycles can depend on the amount of maximum voltage accessible to the controller, the type and size of the object, and the amount of force acting on the envelope $E_2$ and actuator.

Figure 4:
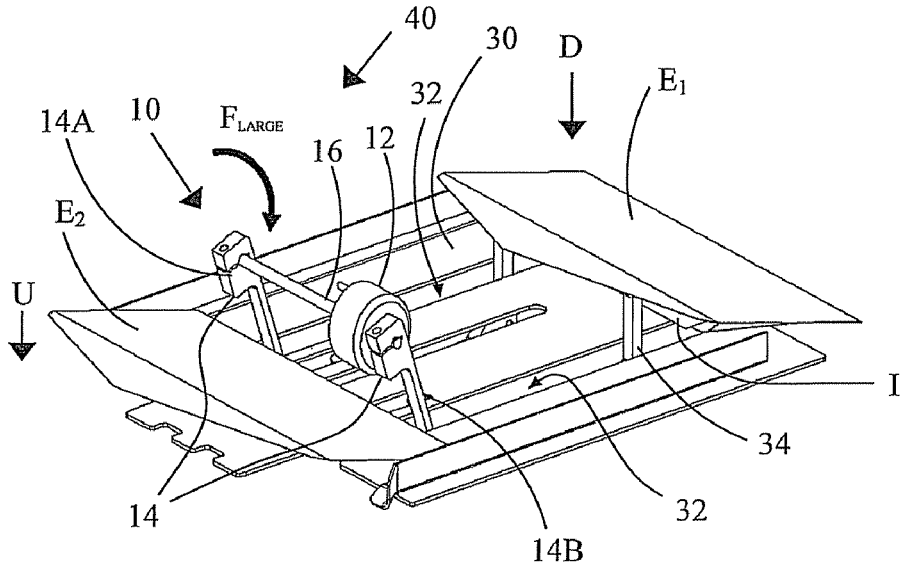

The envelope $E_2$ can be fed onto the process path 30 and moved along the process path 20 at an upstream position U before the actuator 10. As shown in FIG. 4, the envelope $E_2$ can be moved along the process path 30 up to the actuator 10 with its arm 14 in an active position. The unstuffed envelopes can be moved into the process path in different manners, including the envelope feeding mechanism that will be described below with reference to FIGS. 7-14. The envelope $E_2$ can then be registered against the arm 14 to align the envelope $E_2$ in a predetermined position. This predetermined position in which the envelope is placed by the registration can be, for example, an alignment that permits the inserting of the envelope $E_2$ with insert material I.

Figure 5:
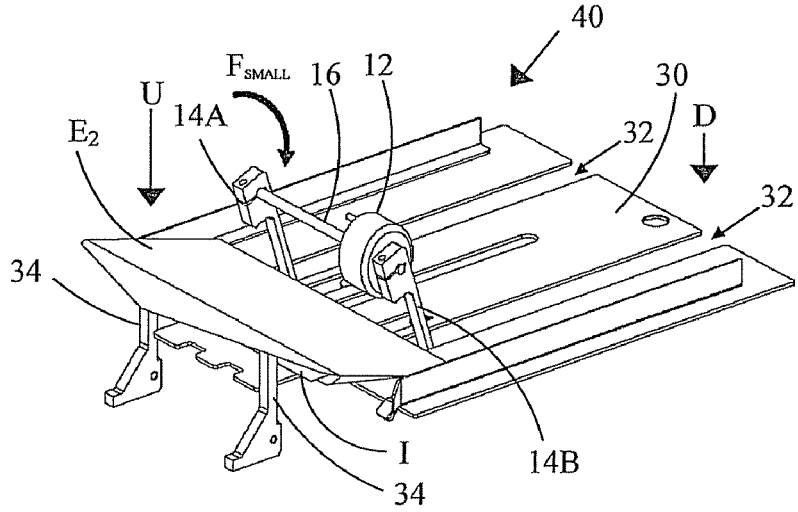
Figure 6:
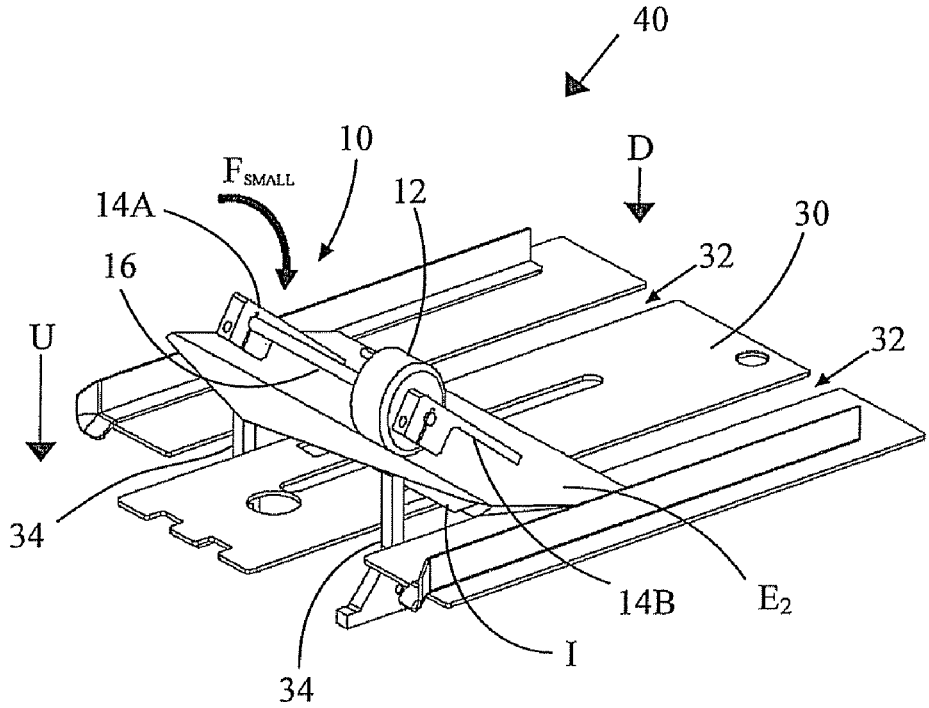

As shown in FIG. 5, the pusher members 34 can push the insert material from an upstream position U towards a downstream position D along the process path 30. At this point, either during insertion or after insertion, a pulse-width modulation having a low pulse-width modulation duty cycle can be provided to the solenoid 12 to provide a less resistive force $F_{SMALL}$ on the arm 14 to permit the envelope $E_2$ to pass by the arm 14. The less resistive force $F_{SMALL}$ can be such that the less resistive force $F_{SMALL}$ will permit the envelope $E_2$ to be push past the arm 14 along the process path 30 by the pusher members 34 as shown in FIG. 6. The less resistive force $F_{SMALL}$ can be such that enough force is provide that the insert material I will be inserted into the envelope and the pusher members 34 contact the envelope before the pusher members 34 pushes the envelope past the arms 14 causing to the arm 14 to raise upward. As stated above, the low pulse-width modulation duty cycle can be a fraction of the high pulse-width modulation duty cycle. Also, the low pulse-width modulation duty cycles can depend on the amount of maximum voltage accessible to the controller, the type and size of the object, and the amount of force acting on the envelope $E_2$ and actuator.

As shown in FIG. 6, upon providing the low pulse-width modulation duty cycle to the solenoid 12, the envelope $E_2$ can move past the arm along the process path 30, the movement of the envelope $E_2$ can rotate the arm 14 of the actuator 10 out of the process path 30 and into a passive position. The less resistive force $F_{SMALL}$ can still provide enough resistance to keep the stuffed envelope $E_2$ registered with the pusher members 34. As described above, the pulse-width modulation having the high pulse-width modulation duty cycle that creates the resistive force $F_{LARGE}$ on arm 14 can be immediately followed by the pulse-width modulation having the low pulse-width modulation duty cycle that creates the less resistive force $F_{SMALL}$ on arm 14. Further, the steps of providing the pulse-width modulation having the high pulse-width modulation duty cycle and providing the pulse-width modulation having the low pulse-width modulation duty cycle can be continually repeated.

Referring now to FIGS. 7-14, one example of a more specific embodiment for using a pulse-width modulation actuator 10, as described above, in a sheet processing system is illustrated. In FIGS. 7-14, an inserting station or system, generally designated 50, is provided for processing sheet articles. In particular, the inserting station 50 can be used to stuff insert material I, such as document sets of sheet articles and/or mailing articles, into an envelope. The inserting station 50 can comprise an actuator 10, a controller 20 and a process path 30. The actuator 10, controller 20 and process path 30 can comprise a system 40 for registering and moving a sheet article along the process path 30 within the inserting station 50. The inserting station 50 and system 40 can be part of a larger sheet processing system. The system 40 can be used to register, i.e. properly align, and move the sheet articles within the larger sheet processing system. The system 40 will be described in the context of the inserting station 50 below.

As illustrated in FIGS. 7-14, the inserting station 50 can comprise a process path 30 for conveying the sheet articles, which can be envelopes and document sets of sheet articles and/or mailing articles that comprise insert material, from an upstream position U to a downstream position D. The inserting station 50 can also comprise an actuator 10 as described above that comprises a solenoid 12 (not shown in FIGS. 7-14; see FIGS. 1A-6) and an arm 14. The solenoid can be a rotary solenoid and can comprise a shaft 16 on which the arm 14 can be attached. The arm 14, for example, can be a single structure. Alternatively, the arm 14 can comprise two or more fingers 14A that are spaced apart from each other along the shaft 16. The actuator 10 can be positioned at a predetermined location along the process path 30 proximate to the process path 30. For example, the actuator 10 can be located on a support carriage 52 above the process path 30 so that the arm 14 of the actuator 10 can be rotated into a position to register envelopes and stuff the envelopes with insert material I before being allowed to move down the process path 30.

For example, in FIGS. 7-10, the support carriage 52 positions the actuator 10 in a location to stop commercial sized envelopes $RE_1$, $RE_2$ after the envelopes $RE_1$, $RE_2$ are fed into the process path 30 by an envelope feeder EF. The commercial sized envelopes $RE_1$, $RE_2$ are designed to receive small or folded sheet articles such as folded letter-sized paper. Thus, the support carriage 52 in FIGS. 7-10 positions the actuator 10 close to the envelope feeder EF. In FIGS. 11-14, the envelopes being processed are catalog sized envelopes $LE_1$, $LE_2$ into which an unfolded sheet article or other type of larger insert material can be inserted. The support carriage 52 positions the actuator 10 in a location to stop catalog sized envelopes $LE_1$, $LE_2$ after the envelopes $LE_1$, $LE_2$ are fed into the process path 30 by an envelope feeder EF. The support carriage 52 in FIGS. 11-14 positions the actuator 10 farther away from the envelope feeder EF and farther down the process path 30 than the position of the actuator 10 within the support carriage 52 in FIGS. 7-10. The support carriage 52 can be fixed so that the actuator 10 is in a fixed, stationary position that is not adjustable. Alternatively, at least portions of the support carriage 52 can be moveable to allow the position of the actuator 10 to be adjustable. An embodiment of an adjustable support carriage 52 as shown in FIGS. 7-14 will be described in more detail below.

Controller 20 can also be included in the system 40 and can be used to control the inserting station 50. Controller 20 can be a computer, a microcomputer, a programmable logic controller, or the like. Controller 20 can be a controller for the entire inserting system of which the inserting station is a part. Alternatively, the controller 20 can be for just the inserting station 50 or the actuator 10. Controller 20 can control the movement of the arm 14 with the solenoid by pulse-width modulation. As described above, the controller 20 can provide a high pulse-width modulation duty cycle to the solenoid to provide a maximum force on the arm 14 to position the arm 14 in the process path to register the envelopes $RE_1$, $RE_2$, $LE_1$, $LE_2$ against the arm 14 to align the envelopes $RE_Q$, $RE_2$, $LE_1$, $LE_2$ in a position to receive insert material I. The controller 20 can also provide a low pulse-width modulation duty cycle to the solenoid to provide a less resistive force on the arm 14 to permit the envelopes $RE_1$, $RE_2$, $LE_1$, $LE_2$ to push past the arm 14 along the process path 30.

The process path 30 can comprise one or more openings 32 into which the arm 14 can extend upon application of force by the solenoid. In particular, the process path 30 can comprise one or more decks 36 that form the openings 32. One or more pusher members 34 (See FIGS. 10 and 14) for moving the sheet article along the process path 30 can also be provided. The pusher members 34 can travel along the openings 32 in the process path 30. The pusher members 34 can be moved along the process path 30 by one or more movable conveyor devices, such as a chain 38. Other movable conveyor devices such as belts can also be used. The pusher members 34 can be fixedly attached to the chain 38. Alternatively, the pusher members 34 can be pivotally attached to the chain 38. In the inserting station 50, the pusher members 34 can be used to push insert material I along the process path 30 and into the envelopes $RE_1$, $RE_2$, $LE_1$, $LE_2$ after the envelopes $RE_1$, $RE_2$, $LE_1$, $LE_2$ are fed onto the process path 30 by the envelope feeder EF and registered against the arm 14 of the actuator 10. As stated above, the insert material I can comprise sheet articles and mail articles that form document sets to be inserted into the envelopes $RE_1$, $RE_2$, $LE_1$, $LE_2$.

The arm 14 can be rotatable into an active position in the process path 30 upon providing a high pulse-width modulation duty cycle from the controller 20 to the solenoid. The torque on the solenoid created by the high pulse-width modulation duty cycle $DC_H$ can be strong enough to force the arm 14 to rotate into the active position and hold the arm 14 in the active position during registration of the envelopes $RE_1$, $RE_2$, $LE_1$, $LE_2$ and insertion of the insert material I. The arm 14 can be configured to be movable to a passive position during a low pulse-width modulation duty cycle to the solenoid by letting the pusher members 34 push the envelopes $RE_1$, $RE_2$, $LE_1$, $LE_2$ past the arm 14, thereby moving the arm 14 upward and out of the process path 30. The arm 14 in this manner can be rotatable out of the process path 30 by the movement of the envelopes $RE_1$, $RE_2$, $LE_1$, $LE_2$ during the period when a less resistive force in the form of torque on the solenoid is applied. In such an embodiment, the actuator 10 does not need a return spring mechanism for returning the arm 14 from an active position because the envelope and pusher members 34 operate to move the arm to a passive position to allow passage of the envelopes $RE_1$, $RE_2$, $LE_1$, $LE_2$. After each envelope passes, the controller 20 can again apply a high pulse-width modulation duty cycle to the solenoid of the actuator 10 to ensure that the arm 14 returns to the active position from the passive position for registration of the next envelope.

As stated above, the support carriage 52 can be adjustable to allow the location of the actuator 10 along the process path 30 to be moveable. In particular, in the embodiment shown, the location of the actuator 10 relative to the envelope feeder EF can be changed. As shown in FIGS. 7-14, this allows for processing different sized envelopes and insert materials I. The support carriage 52 can comprise a frame 54 that holds an actuator carrier 56 between guide rails 58. The solenoid carrier 56 has the actuator 10 installed therein so that the arms 14 are rotatable into the process path 30. An adjuster 60 can be provided that permits the movement of the actuator carrier 56 within the frame 54 of the support carriage 52. The adjuster 60 can comprise a rod 62 that is retained by the frame 54 and is rotatable within the frame 54. The rod 62 can pass through an aperture (not shown) in the actuator carrier 56. Both the rod 62 and the aperture in the actuator carrier 56 can be threaded so that as the rod 62 rotates the actuator carrier 56 moves up and down the rod 62 depending on the direction of rotation of the rod 62. The guide rails 58 prevent the rotation of the actuator carrier 56 with the rotation of the rod 62 to cause the actuator carrier 56 to move up and down the rod 62 depending on the direction of rotation of the rod 62.

Figure 10:
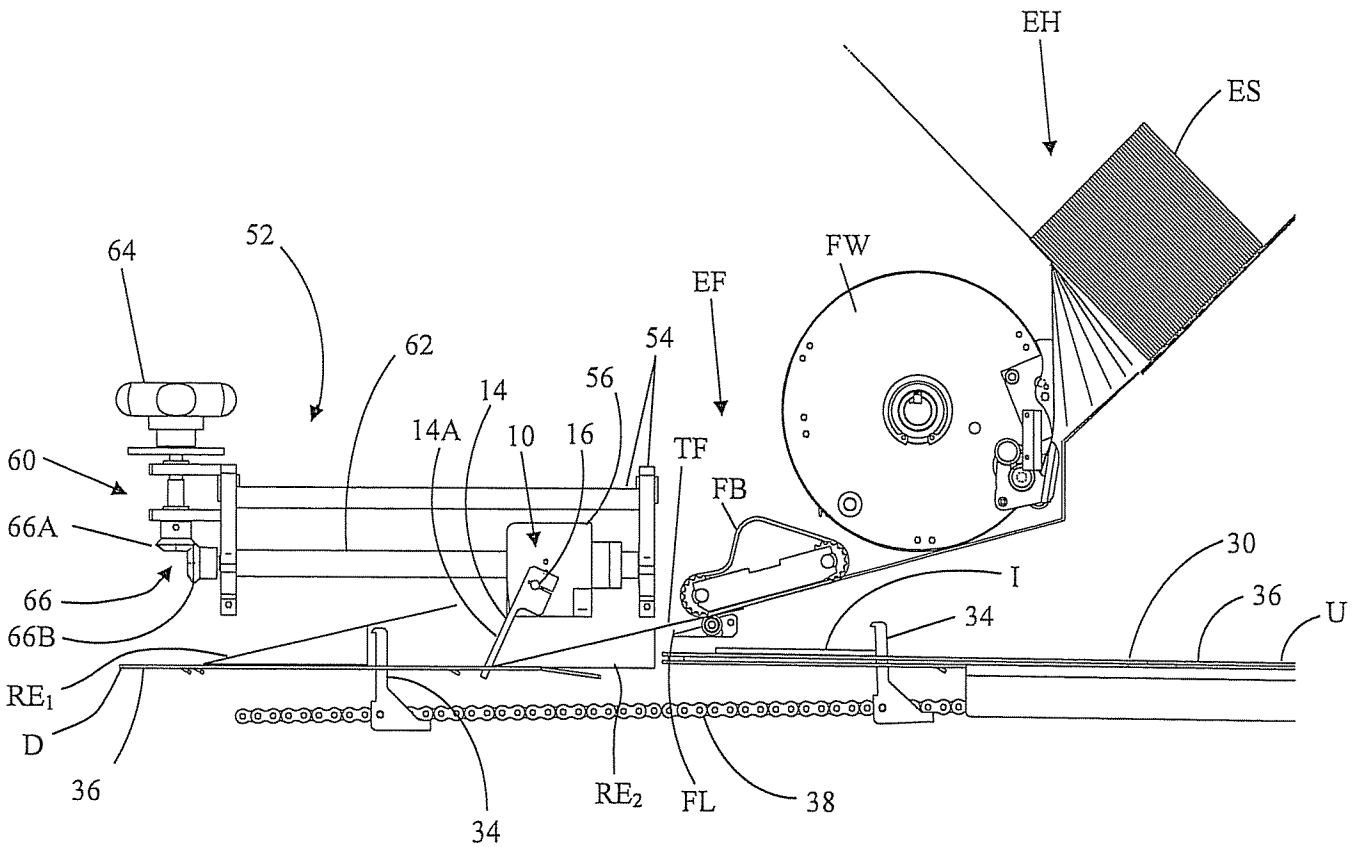
Figure 14:
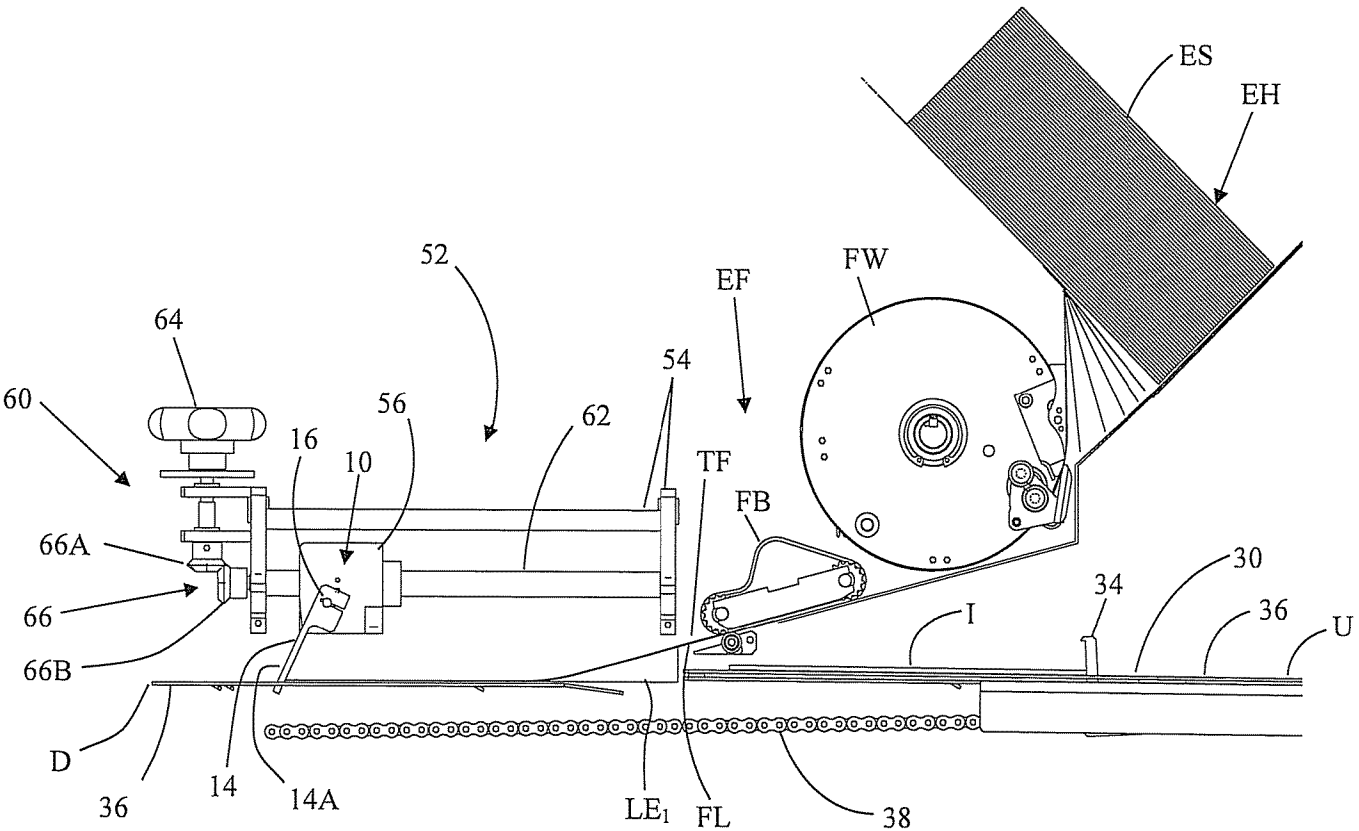

The adjuster 60 can also comprise a handle 64 that can be used to turn, or rotate, the rod 62. The handle 64 can be positioned at different locations on the support carriage 52. For example, the handle 64 can be located on the side of frame 54 (not shown) and can be directly attached to the end of the rod 62 so that the turning of the handle 64 will result directly in the turning of the rod 62. Alternatively, the handle 64 can extend upward from the frame 54 at an angle to rod 62 as shown in FIGS. 10 and 14. In such an embodiment, the handle 64 can be attached to a gearing arrangement 66 to transfer the rotation of the handle 64 to the rod 62. For example, the handle 64 can be at approximately a right angle to the rod 62 and bevel gears 66A and 66B in the gearing arrangement 66 can translate the turning of the handle 64 to the turning of the rod 62. With the turning of the rod 62, the actuator carrier 56 will move along the rod 62 depending on the direction rotation of the handle 64 and the rod 62. In this manner, the actuator 10 within the actuator carrier 56 can be moved into a position where the actuator 10 can properly register the envelopes and hold the envelopes in position to be stuffed with insert material I depending on the size of the envelopes being processed.

Thus, the support carrier 52, as shown in the embodiment illustrated in FIGS. 7-14, can permit the adjustment of the location of actuator 10 along the process path 30 to fit the size of the envelopes $RE_1$, $RE_2$, $LE_1$, $LE_2$. In the embodiment shown, the envelope feeder can be positioned above the process path 30 to feed the envelopes onto the process path 30. The actuator 10 is positioned close enough to the envelope feeder EF so that a top flap TF of the envelope $RE_2$, $LE_I$ that is registered against the arm 14 of the actuator 10 when the arm 14 is in the active position resides on a portion of the envelope feeder EF to hold the envelope in an open position for insertion of the insert material I into the envelope. To accomplish this as shown in FIGS. 10 and 14, the position of the actuator 10 relative to the envelope feeder EF can be changed depending on the size of the envelope.

Any envelope feeder EF can be used that provides a feed of the envelopes at such an angle as to hold open the envelope within the process path for receipt of the insert material I therein. A generic envelope feeder EF is represented in FIGS. 7-14. A stack ES of envelopes can be placed in an envelope holder EH. A feeder wheel FW can pull individual envelopes into the envelope feeder EF which can then be grabbed by a feed belt FB that ejects the envelope onto process path 30. The actuator 10 can be actuated so that the arm 14 is in the active position to stop and register the envelope at a position where the top flap TF of the envelope still resides on a lip FL of the envelope feeder EF. In this manner, the envelope can be held in an open position for insertion of the insert material therein. The upstream portion U of the process path that is before the support carriage 52 can be at a higher elevation as compared to the downstream portion D of the process path 30 to facilitate insertion of the insert material I into the envelope $RE_2$, $LE_1$ as shown in FIGS. 10 and 14.

Figure 7:
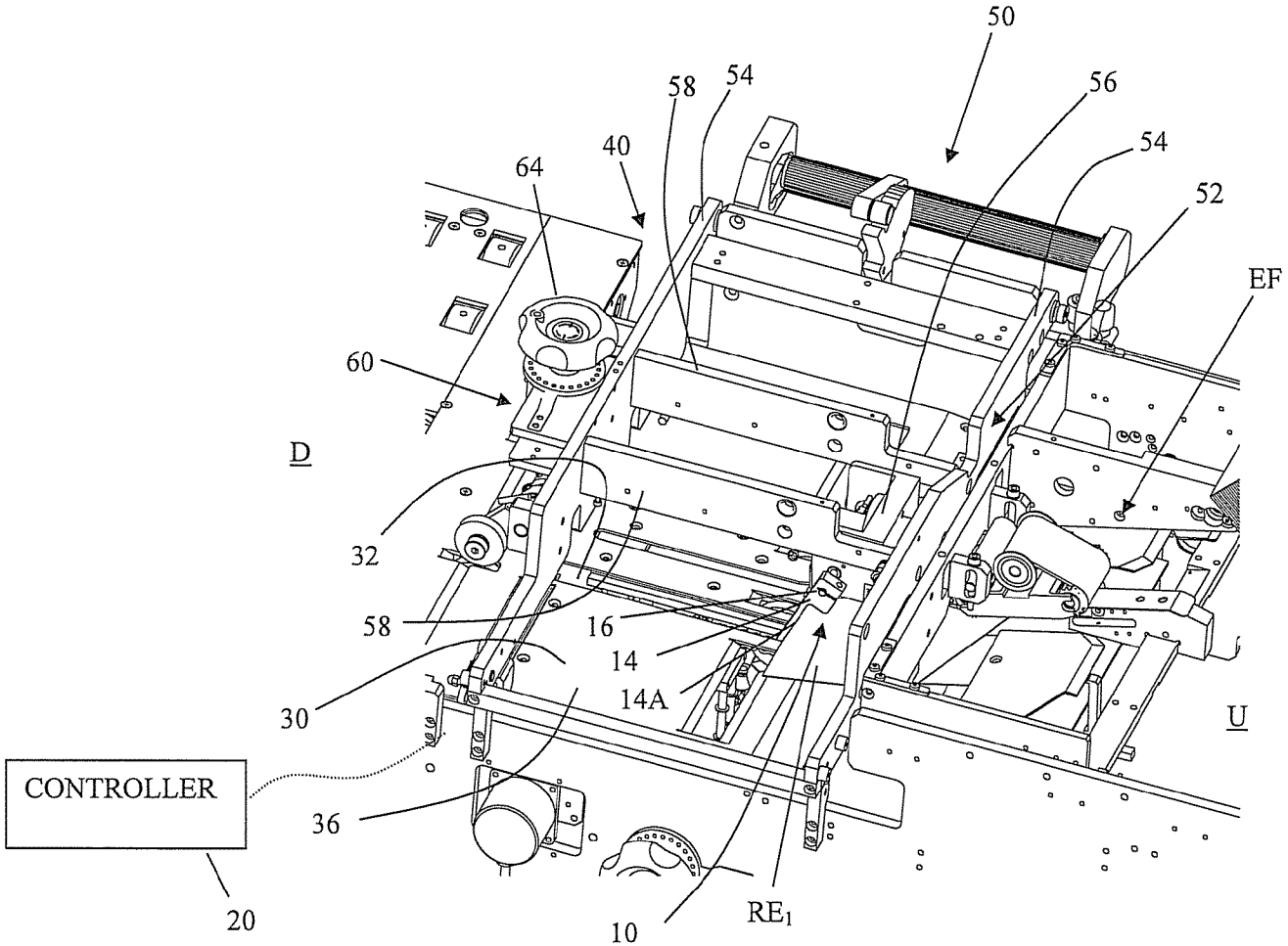
FIGS. 7-10 illustrate perspective views of an embodiment of a system within an inserting station using a pulse-width modulation controlled actuator according to FIGS. 1A and 1B configured to use envelopes of one size.
Figure 11:
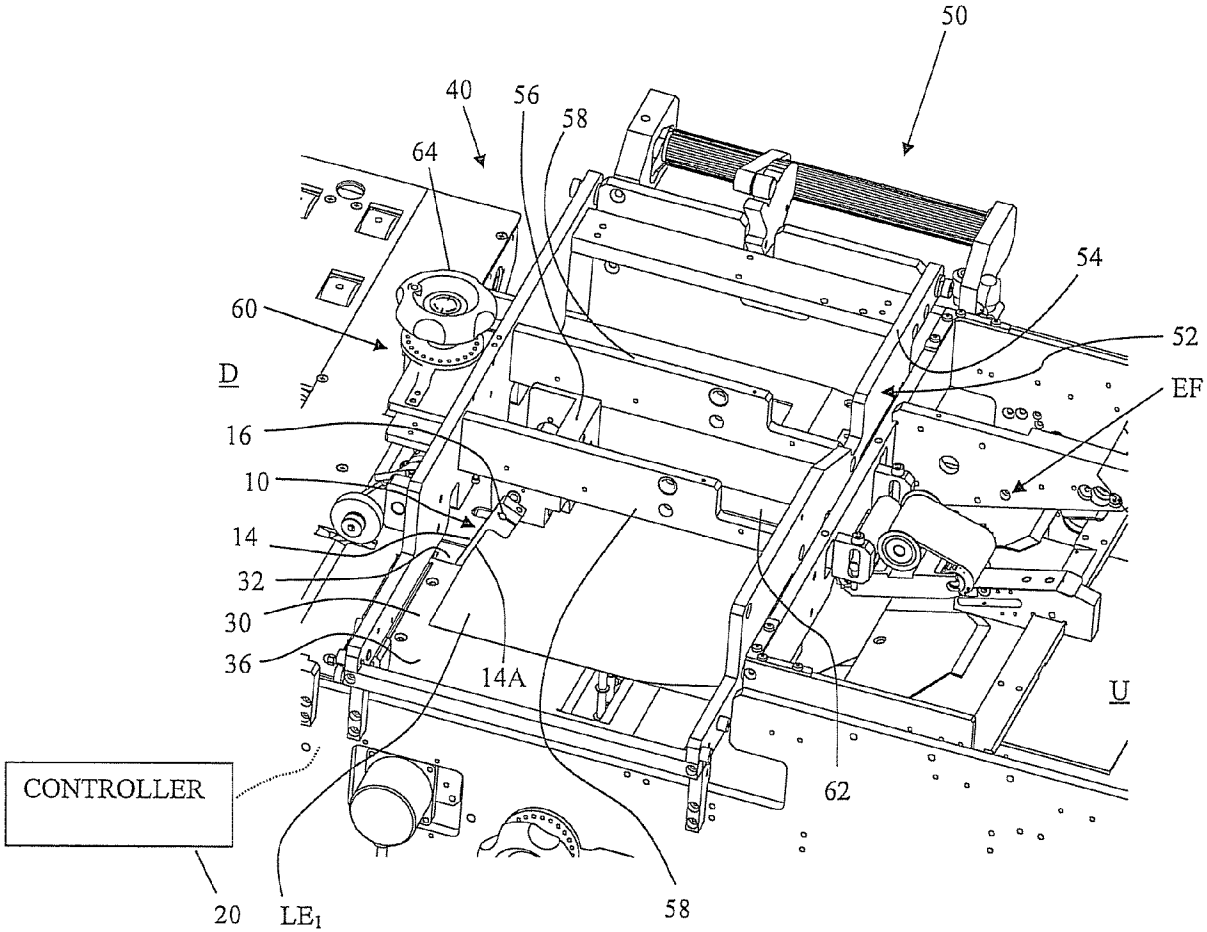
FIGS. 11-14 illustrate perspective views of the embodiment of a system within the inserting station illustrated in FIGS. 7-11 configured to use a different sized envelope.

The operation of the inserting station 50 will be described in more detail below. As shown in FIGS. 7 and 11, the actuator carrier 56 can be adjusted to an appropriate position so that the actuator 10, when activated, will register the envelopes $RE_1$, $LE_1$ and hold the envelopes $RE_1$, $LE_1$ for insertion of insert material I. To rotate the actuator 10 into an active position, a pulse-width modulation having a high pulse-width modulation duty cycle can be supplied to the actuator 10 to provide a greater resistive force on the arm 14 to position the arm 14 in the process path 30. The high pulse-width modulation duty cycle can occur be over-exciting the solenoid in the actuator 10. For example, if the solenoid is rated for 6 volts, a supply of 24 volts can be provided for a very short time period to quickly move the arm 14 into the active position. In this active position, the arm 14 can extend through the process path 30. For example, the arm 14 in the form of fingers 14A can extend into the openings 32 in the process path 30 in which the pusher members 34 can travel as shown in FIGS. 10 and 14. The envelopes $RE_1$, $LE_1$ can be held open as described above with the top flap of each envelopes $RE_1$, $LE_1$ residing on a portion of the envelope feeder EF such as feeder lip FL.

Figure 8:
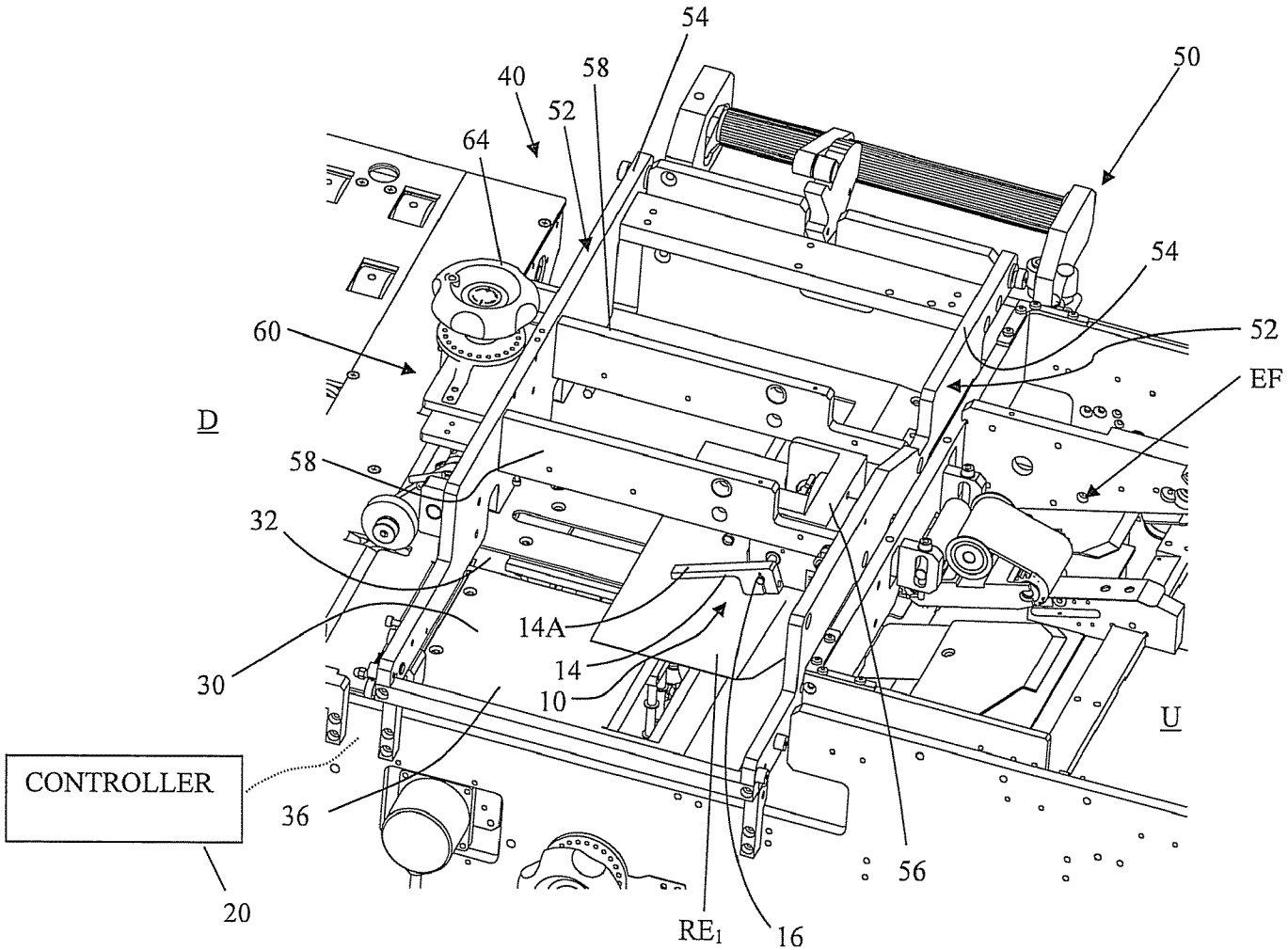
Figure 9:
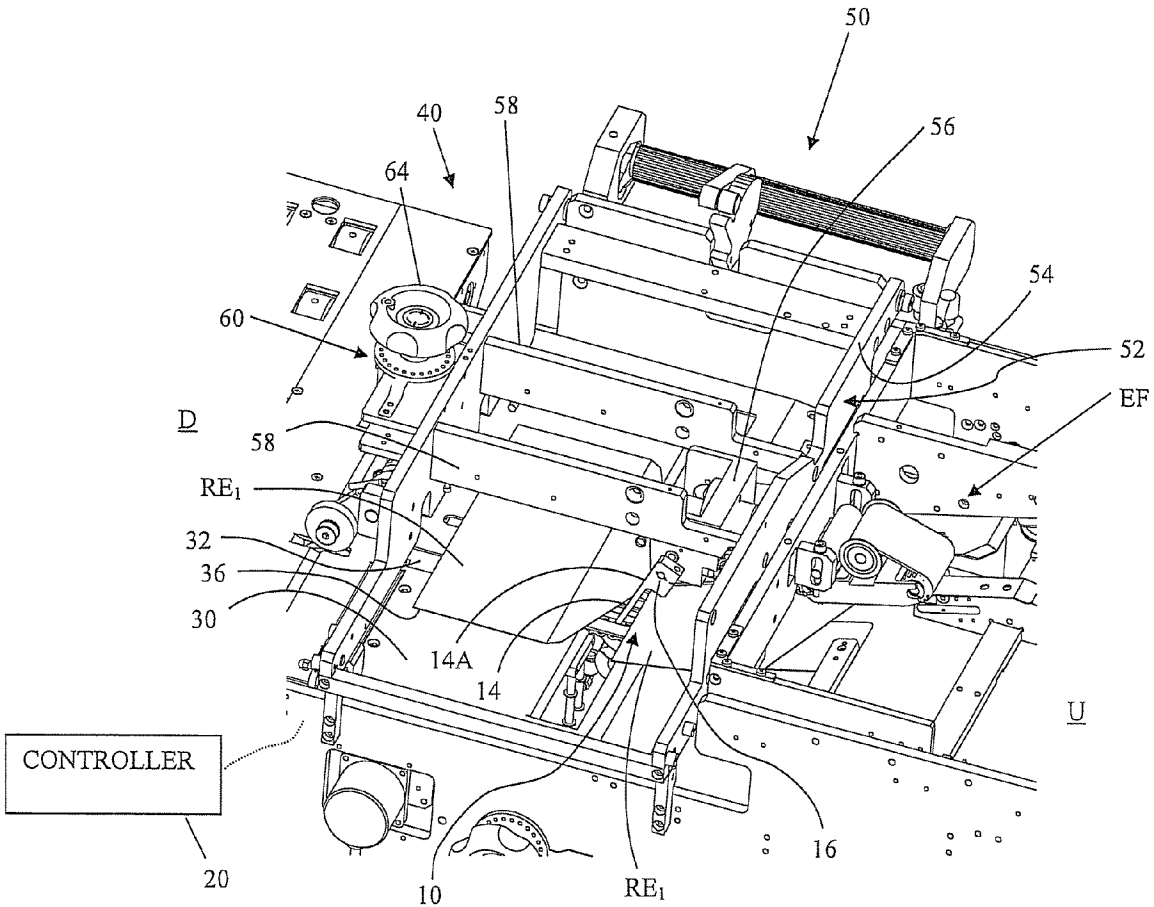
Figure 12:
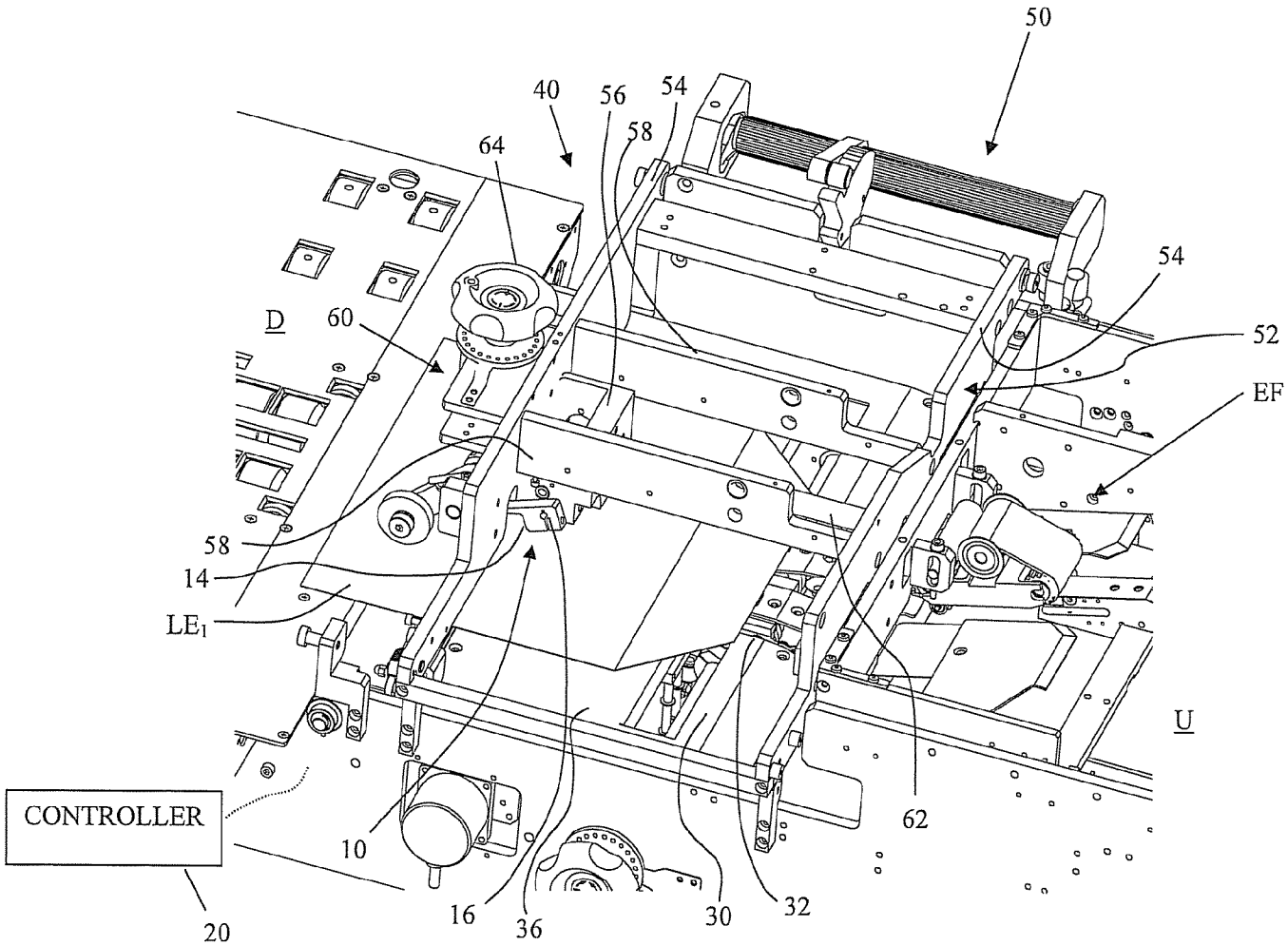
Figure 13:
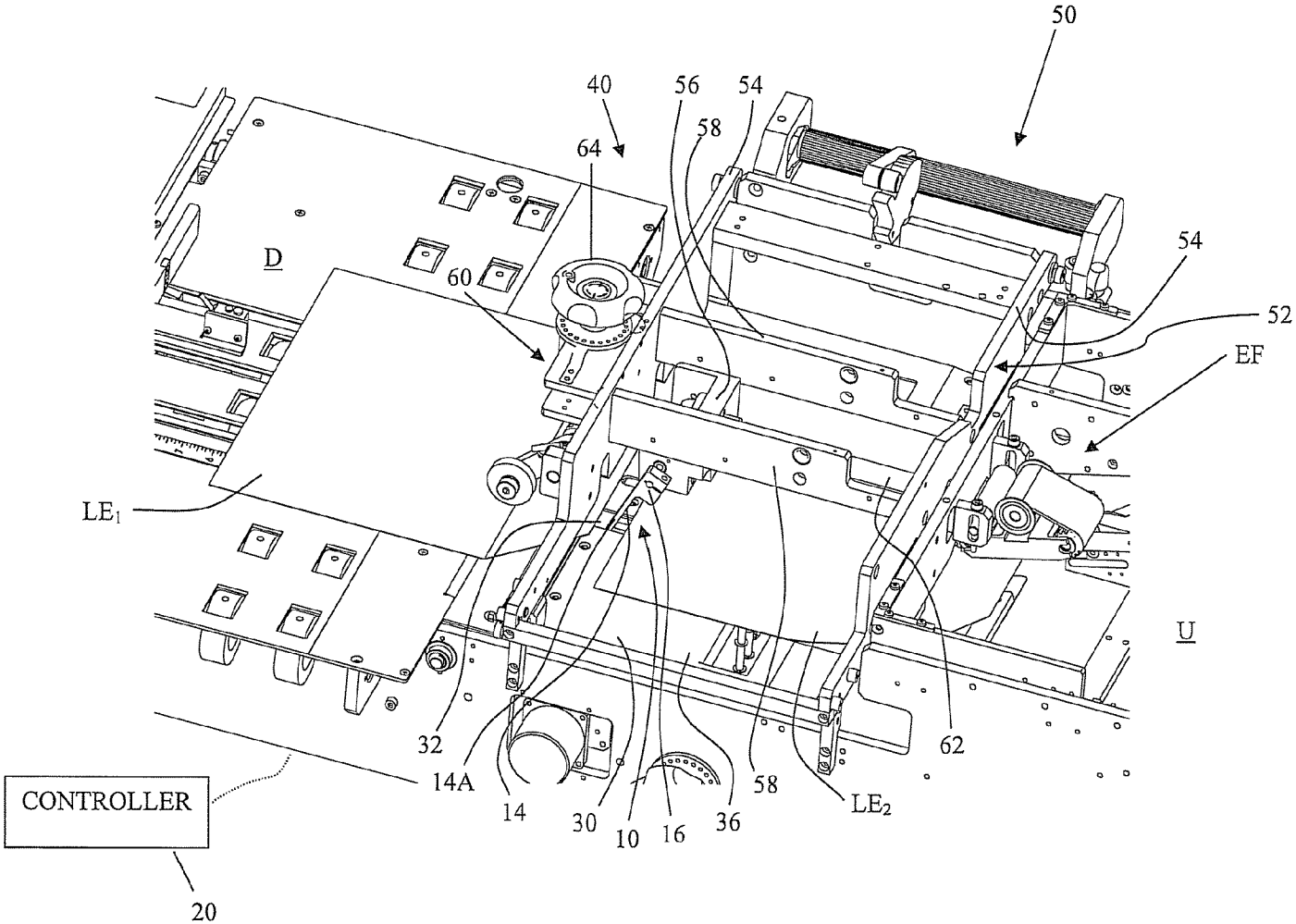

As shown in FIGS. 10 and 14, the pusher members 34 can push insert material I from an upstream position U towards a downstream position D along the process path 30. At this point, either during insertion or after insertion, a pulse-width modulation having a low pulse-width modulation duty cycle can be provided to the solenoid of the actuator 10 to provide a less resistive force on the arm 14 to permit the envelope $RE_1$, $LE_1$ to pass by the arm 14. The less resistive force can be such that it will permit the envelope $RE_1$, $LE_1$ to be push past the arm 14 along the process path 30 by the pusher members 34 as shown in FIGS. 8 and 12. As stated above, the low pulse-width modulation duty cycle can be a fraction of the high pulse-width modulation duty cycle. After the first envelope $RE_1$, $LE_1$ is stuffed and moved down stream from the actuator 10, the solenoid of the actuator 10 can be over-excited again to provide a high pulse-width modulation duty cycle to provide a greater resistive force on the arm 14 to position the arm 14 in an active position again for the registration and holding of a second envelope $RE_2$, $LE_2$ in the process path 30 as shown in FIGS. 9 and 13.

As stated above, the pulse-width modulation having the high pulse-width modulation duty cycle that creates a greater resistive force on arm 14 can be immediately followed by the low pulse-width modulation duty cycle that creates the less resistive force on arm 14. Further, the steps of providing the pulse-width modulation having the high pulse-width modulation duty cycle and the low pulse-width modulation duty cycle can be continually repeated.

Embodiments of the present disclosure shown in the drawings and described above are exemplary of numerous embodiments that can be made within the scope of the above disclosure and appending claims. It is contemplated that the configurations of the pulse-width modulated actuator systems, apparatuses, and methods of using the same can comprise numerous configurations other than those specifically disclosed. The scope of a patent issuing from this disclosure will be defined by these appending claims.

What is claimed is:

1. A method for registering and moving a sheet article along a process path, the method comprising:

providing an actuator comprising a solenoid and an arm;

controlling movement of the arm with the solenoid by pulse-width modulation;

moving a sheet article along a process path;

providing a pulse-width modulation having a high pulse-width modulation duty cycle to the solenoid to provide a resistive force on the arm to position the arm in the process path;

registering the sheet article against the arm to align the sheet article in a predetermined position; and providing a pulse-width modulation having a low pulse-width modulation duty cycle to the solenoid to provide a less resistive force on the arm to permit the sheet article to push past the arm along the process path.

2. The method according to claim 1, wherein the solenoid is a rotary solenoid that rotates the arm about an axis.

3. The method according to claim 2, further comprising rotating the arm into an active position in the process path upon providing the high pulse-width modulation duty cycle to the solenoid.

4. The method according to claim 3, further comprising, upon providing the low pulse-width modulation duty cycle to the solenoid, moving the sheet article past the arm along the process path, the movement of the sheet article rotating the arm out of the process path and into a passive position.

5. The method according to claim 1, further comprising extending the arm through the process path upon application of the resistive force by the solenoid.

6. The method according to claim 1, wherein the steps of providing the high pulse-width modulation duty cycle and providing the low pulse-width modulation duty cycle are continually repeated.

7. A system for registering and moving a sheet article along a process path, the system comprising:

a process path for conveying a sheet article from an upstream position to a downstream position;

an actuator comprising a solenoid and an arm positioned at a predetermined location proximate to the process path; and a controller for controlling movement of the arm with the solenoid by pulse-width modulation, the controller providing a pulse-width modulation having a high pulse-width modulation duty cycle to the solenoid to provide a resistive force on the arm to position the arm in the process path to register the sheet article against the arm to align the sheet article in a predetermined position, and the controller providing a pulse-width modulation having a low pulse-width modulation duty cycle to the solenoid to provide a less resistive force on the arm to permit the sheet article to push past the arm along the process path.

8. The system according to claim 7, wherein the process path comprises one or more openings into which the arm is extendable upon application of the resistive force by the solenoid.

9. The system according to claim 8, further comprising one or more pusher members for moving the sheet article along the process path and the pusher members are configured to travel along the openings in the process path.

10. The system according to claim 7, wherein the solenoid is a rotary solenoid for rotating the arm about an axis and the arm is rotatable into an active position in the process path upon providing the high pulse-width modulation duty cycle to the solenoid.

11. The system according to claim 10, wherein the actuator is configured such that, upon providing the low pulse-width modulation duty cycle to the solenoid, the sheet article is movable past the arm along the process path and the arm is rotatable out of the process path and into a passive position by the movement of the sheet article.

12. The system according to claim 7, wherein the arm comprises two or more fingers.

13. The system according to claim 7, wherein the actuator has no return spring mechanism secured to the arm for returning the arm from the active position.

14. The system according to claim 7, wherein the controller continually repeats providing the high pulse-width modulation duty cycle followed by providing the low pulse-width modulation duty cycle.

15. An inserting station for a sheet article processing system, the inserting station comprising:

a process path for conveying a sheet article from an upstream position to a downstream position;

an envelope feeder for feeding an envelope onto the process path;

an actuator comprising a solenoid and an arm positioned at a predetermined location proximate to the process path;

a support carriage for holding the actuator in a position relative to the process path to permit the arm of the actuator to rotate into the process path;

a controller for controlling the movement of the arm with the solenoid by pulse-width modulation, the controller providing a pulse-width modulation having a high pulse-width modulation duty cycle to the solenoid to provide a resistive force on the arm to position the arm in the process path to register the envelope against the arm to align the envelope for insertion of insert material into the envelope, and the controller providing a pulse-width modulation having a low pulse-width modulation duty cycle to the solenoid to provide a less resistive force on the arm to permit the envelope to push past the arm along the process path after insertion of the insert material.

16. The inserting station according to claim 15, wherein the process path comprises one or more openings into which the arm is extendable upon application of the resistive force by the solenoid.

17. The inserting station according to claim 16, further comprising one or more pusher members for moving the insert material and envelopes having the insert material inserted therein along the process path and the pusher members being configured to travel along the openings in the process path.

18. The inserting station according to claim 15, wherein the arm of the actuator is rotatable into an active position in the process path upon providing the high pulse-width modulation duty cycle to the solenoid and the actuator is configured such that, upon providing the low pulse-width modulation duty cycle to the solenoid, the envelope is movable past the arm along the process path and the arm is rotatable out of the process path and into a passive position by the movement of the envelope.

19. The inserting station according to claim 15, wherein the support carriage comprises an actuator carrier in which the actuator resides, the actuator carrier being movable within the support carriage so that the actuator is adjustable to different locations to accommodate the processing of different sized envelopes.

20. The inserting station according to claim 19, wherein the actuator is configured to be positionable within the support carriage relative to the envelope feeder so that, when the envelope is registered against the arm of the actuator, a flap of the envelope resides against a portion of the envelope feeder to hold the envelope in an open position.

* * * * *